US009222642B2

(12) United States Patent
Hsu et al.

(10) Patent No.: US 9,222,642 B2
(45) Date of Patent: Dec. 29, 2015

(54) LAMP WITH LIGHT GUIDE LENS FOR LATERAL ILLUMINATION

(71) Applicant: Genius Electronic Optical Co., Ltd., Taichung (TW)

(72) Inventors: Hui-Ju Hsu, Taichung (TW); Fu-Kuang Hsiao, Taichung (TW)

(73) Assignee: GENIUS ELECTRONIC OPTICAL CO., LTD. (TW)

( * ) Notice: Subject to any disclaimer, the term of this patent is extended or adjusted under 35 U.S.C. 154(b) by 233 days.

(21) Appl. No.: 14/061,829

(22) Filed: Oct. 24, 2013

(65) Prior Publication Data

US 2015/0062882 A1 Mar. 5, 2015

(30) Foreign Application Priority Data

Aug. 30, 2013 (TW) ..... 102216291 U

(51) Int. Cl.

| | |
|---|---|
| ***F21V 14/04*** | (2006.01) |
| ***F21V 5/00*** | (2015.01) |
| ***F21L 4/08*** | (2006.01) |
| ***F21V 13/04*** | (2006.01) |
| ***F21L 4/02*** | (2006.01) |
| ***F21V 21/096*** | (2006.01) |
| *F21V 7/00* | (2006.01) |
| *F21Y 101/02* | (2006.01) |
| *F21V 29/77* | (2015.01) |

(52) U.S. Cl.

CPC ..... *F21V 5/006* (2013.01); *F21L 4/027* (2013.01); *F21L 4/08* (2013.01); *F21V 13/04* (2013.01); *F21V 21/0965* (2013.01); *F21V 7/0033* (2013.01); *F21V 29/77* (2015.01); *F21Y 2101/02* (2013.01)

(58) Field of Classification Search

CPC . F21Y 2101/02; F21V 7/0066; F21V 7/0075; F21V 7/041; F21V 14/04; F21V 14/045; F21L 4/04; F21L 15/02

See application file for complete search history.

(56) References Cited

U.S. PATENT DOCUMENTS

| | | | | |
|---|---|---|---|---|
| 4,903,178 | A * | 2/1990 | Englot et al. | 362/183 |
| 5,412,548 | A * | 5/1995 | Yee | 362/202 |
| 5,816,688 | A * | 10/1998 | Shui-Shang | 362/253 |
| 6,361,190 | B1 * | 3/2002 | McDermott | 362/310 |
| 6,598,993 | B1 * | 7/2003 | Dalton et al. | 362/202 |
| 6,607,286 | B2 * | 8/2003 | West et al. | 362/255 |
| 6,674,096 | B2 * | 1/2004 | Sommers | 257/98 |
| 6,857,756 | B2 * | 2/2005 | Reiff et al. | 362/184 |
| 7,059,743 | B2 * | 6/2006 | Niemann | 362/184 |
| 7,438,444 | B2 * | 10/2008 | Pao et al. | 362/327 |
| 7,473,007 | B1 * | 1/2009 | Wang | 362/187 |
| 7,988,337 | B2 * | 8/2011 | Huang | 362/299 |
| 2007/0030672 | A1 * | 2/2007 | Offiler et al. | 362/198 |

FOREIGN PATENT DOCUMENTS

TW M405512 B2 6/2011

* cited by examiner

*Primary Examiner* — Ismael Negron
(74) *Attorney, Agent, or Firm* — Baker & McKenzie LLP

(57) ABSTRACT

A lamp with light guide lens for lateral includes a body, a light-emitting element, a light guide lens and a movable housing which are disposed on the body. When the movable housing moves until the light guide lens is located within the hole of a reflection cup of the movable housing, the lateral light from the light guide lens will be reflected by the reflection cup and emitted out of the front light-passing portion, when the movable housing moves until the light guide lens is not within the hole, and the lateral light-passing portion extends out of the body, the lateral light from the light guide lens will be emitted out of the lateral light-passing portion.

8 Claims, 7 Drawing Sheets

LAMP WITH LIGHT GUIDE LENS FOR LATERAL ILLUMINATION

BACKGROUND OF THE INVENTION

1. Field of the Invention

The present invention relates to a lamp, and more particularly to a lamp with light guide lens for lateral illumination.

2. Description of the Prior Art

Normally, a handheld lamp is capable of emitting light only in the forward direction. FIG. 1 shows a conventional handheld lamp which is capable of emitting light in the lateral direction, wherein the handheld lamp is an electric torch 10 which comprises a transparent sleeve 12 sleeved onto a barrel 11, a light transmitting housing 13 screwed on the transparent sleeve 12, and a light emitting element 14 disposed in the transparent sleeve 12. When the light transmitting housing 13 is rotated to a position where the transparent sleeve 12 is covered in the light transmitting housing 13, the light of the light emitting element 14 will be emitted from the front end of the light transmitting housing 13, namely, the light is emitted in the frontward direction.

When the light transmitting housing 13 is rotated to a position where the transparent sleeve 12 extends out of the light transmitting housing 13, the light of the light emitting element 14 will be dispersedly emitted from the front end of the light transmitting housing 13 and the transparent sleeve 12, resulting in a poor lighting effect.

The present invention has arisen to mitigate and/or obviate the afore-described disadvantages.

SUMMARY OF THE INVENTION

The primary objective of the present invention is to provide a lamp with light guide lens for lateral illumination.

A lamp with light guide lens for lateral illumination in accordance with the present invention comprises: a body, a light-emitting element, a light guide lens and a movable housing.

The body includes a front end and a rear end. A direction extending from the front end to the rear end is defined as an axial direction, and any non-axial direction is defined as a lateral direction.

The light emitting element is disposed at the front end of the body.

The light guide lens is disposed at the front end of the body and abuts against the light emitting element. The light guide lens includes a first end, a second end and a peripheral surface between the first and second ends. A concave reflection surface concave toward the second end is formed at the first end to reflect the light emitted from the light emitting element into the lateral direction, and the second end is formed with a recess for accommodation of the light emitting element.

The movable housing is movably disposed at the front end of the body and includes a front light-passing portion, a lateral light-passing portion and a reflection cup between the front and lateral light-passing portions. The reflection cup includes a hole facing the light guide lens. When the movable housing moves until the light guide lens is located within the hole, the lateral light from the light guide lens will be reflected toward the front light-passing portion by the reflection cup. When the movable housing moves until the light guide lens is not within the hole, and the lateral light-passing portion extends out of the body, the lateral light from the light guide lens will be emitted directly toward the lateral light-passing portion.

With the light guide lens and the movable housing movably disposed on the body of the light emitting apparatus, light is allowed to be collectively emitted from the front light-passing portion of the movable housing in a forward emission manner by moving the movable housing to a position where the light guide lens is located within the movable housing, or the light can be emitted from the lateral light-passing portion in a lateral emission manner by moving the movable housing to a position where the light guide lens is not located within the movable housing.

DETAILED DESCRIPTION OF THE PREFERRED EMBODIMENTS

Figure 1:
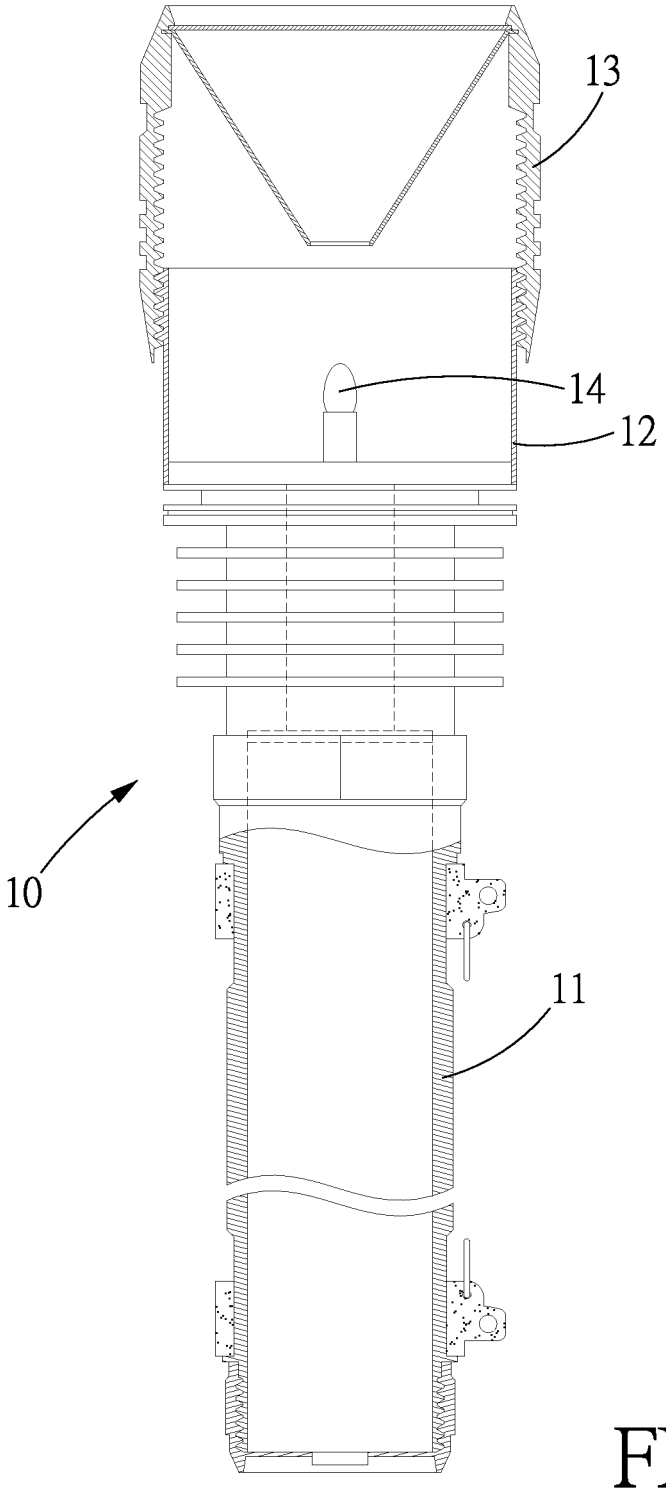
FIG.1 PRIOR ART
FIG. 1 shows a conventional electric torch.

The present invention will be clearer from the following description when viewed together with the accompanying drawings, which show, for purpose of illustrations only, the preferred embodiment in accordance with the present invention.

Referring to FIGS. 2-7, a lamp with light guide lens for lateral illumination in accordance with the present invention comprises: a body 20, a light-emitting element 30, a light guide lens 40 and a movable housing 50.

The body 20 includes a front end 22, a rear end 23 and a charging portion 21 between the front and rear ends 22, 23. A direction extending from the front end 22 to the rear end 23 is defined as an axial direction X, and any non-axial direction is defined as a lateral direction A. At the front end 22 of the body 20 is formed a slide groove 221 which extends in the axial direction X and includes a slide-groove inner surface 222. On the slide-groove inner surface 222 is formed a stop portion 223, and at the rear end 23 is disposed a magnet 24.

The light emitting element 30 is disposed at the front end 22 of the body 20.

The light guide lens 40 is disposed at the front end 22 of the body 20 and abuts against the light emitting element 30. The light guide lens 40 includes a first end 41, a second end 42 and a peripheral surface 43 between the first and second ends 41, 42. The peripheral surface 43 is inclined at an angle θ with respect to the axial direction X. A concave reflection surface 411 concave toward the second end 42 is formed at the first end 41, and the second end 42 is formed with a recess 421 which includes a bottom surface 422 and an open end 423. The bottom surface 422 is an arc-shaped surface convex toward the open end 423. A conjunction between the first end 41 and the peripheral surface 43 of the light guide lens 40 is defined as a front top point 412, and a part of the reflection surface 411 of the first end 41 located closest to the second end 42 is defined as a front bottom point 413. A part of the bottom surface 422 located furthest from the first end 41 is defined as a rear top point 424. A distance between the front top point 412 and the front bottom point 413 is defined as a first distance D1, a distance between the front bottom point 413 and the rear top point 424 is defined as a second distance D2, and when they satisfy the relation: $0.7 \leq D2/D1 \leq 1$ (in this embodiment, D2/D1=0.9), it ensures that the light will be refracted through the bottom surface 422 to the reflection surface 411 of the first end 41. The light emitting element 30 is disposed in the recess 421 of the light guide lens 40, and the light from the light emitting element 30 will be reflected by the reflection surface 411 of the light guide lens 40 into the lateral direction A and become a lateral light.

The movable housing 50 is movably disposed at the front end 22 of the body 20 and includes a front light-passing portion 51, a lateral light-passing portion 52 and a reflection cup 53 between the front and lateral light-passing portions 51, 52. The front light-passing portion 51 is a cap structure with a front light-passing surface 511. The lateral light-passing portion 52 has one end screwed to the inner surface of the front light-passing portion 51 and another end formed with a limit portion 521. The lateral light-passing portion 52 is made of light transmitting material and formed with a slot 522. The reflection cup 53 includes a hole 531 and an arc-shaped concave surface 532 around a periphery of the hole 531. In this embodiment, the arc-shaped concave surface 532 is concave toward the light guide lens 40. The reflection cup 53 can reflect light and disposed on at a side of the front light-passing surface 511 facing the light guide lens 40. The lateral light-passing portion 52 of the movable housing 50 is movably disposed in the slide groove 221 of the body 20, and the travel length of the movable housing 50 is limited by the limit portion 521 and the stop portion 223. When the movable housing 50 moves until the light guide lens 40 is located within the hole 531, the lateral light from the light guide lens 40 will be reflected toward the front light-passing portion 51 by the reflection cup 53. When the movable housing 50 moves until the light guide lens 40 is not within the hole 531, and the lateral light-passing portion 52 extends out of the body 20, the lateral light from the light guide lens 40 will be emitted directly toward the lateral light-passing portion 52.

Figure 2:
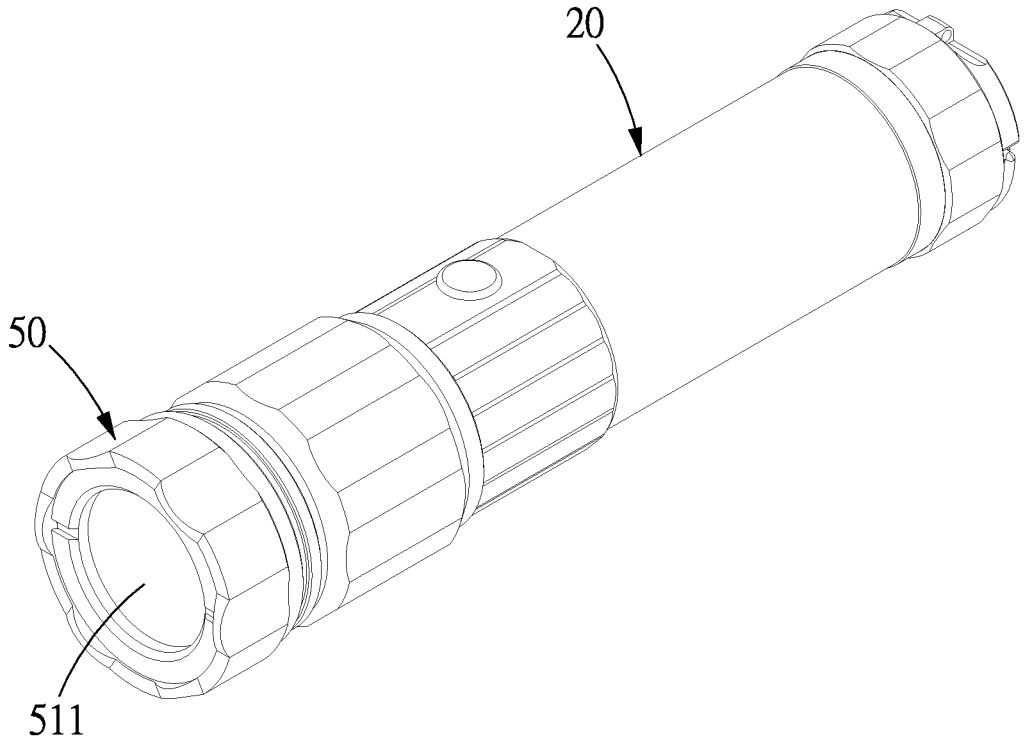
FIG. 2 shows a forward emission condition of a lamp with light guide lens for lateral illumination in accordance with the present invention.
Figure 3:
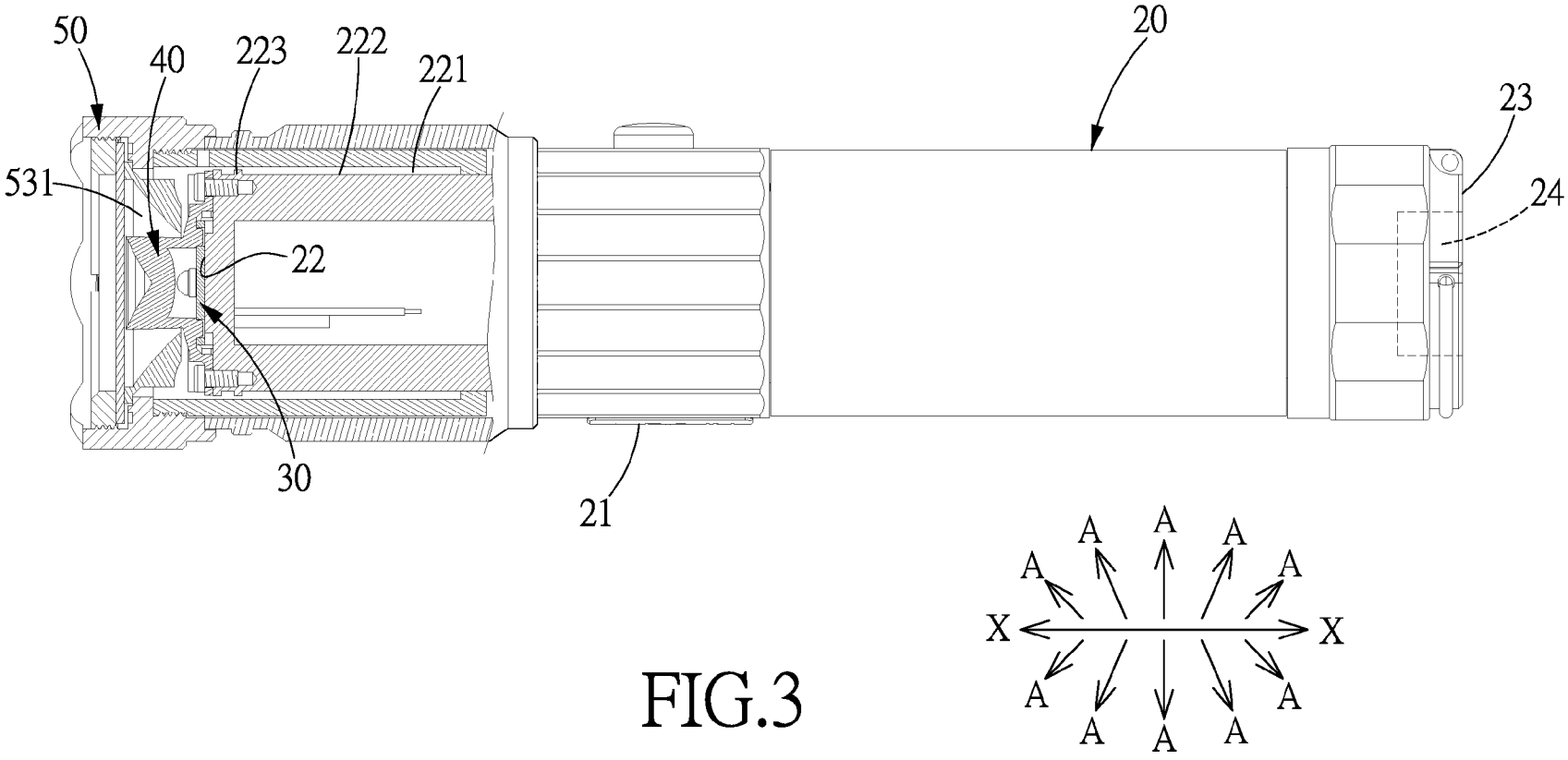
FIG. 3 is a partial cross sectional view of FIG. 2.
Figure 4:
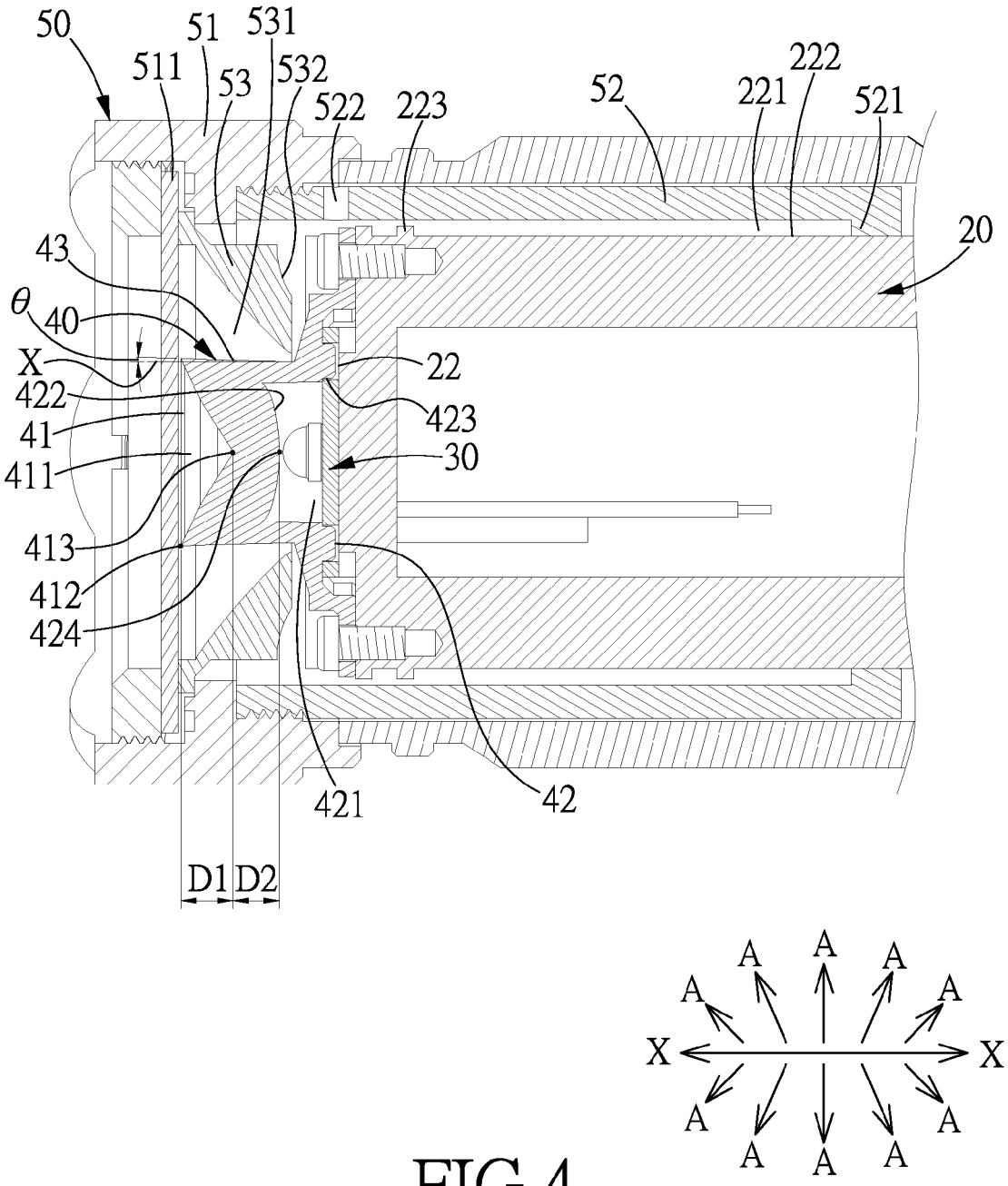
FIG. 4 is a cross sectional view of a part of FIG. 3.

As shown in FIGS. 2-4, when the lateral light-passing portion 52 of the movable housing 50 is fully retracted into the slide groove 221 of the body 20, no light will be emitted out in the lateral direction. At this moment, the front light-passing portion 51 is positioned against the front end 22 of the body 20. The light emitted from the light emitting element 30 is reflected toward the peripheral surface 43 by the reflection surface 411, and then refracted out of the peripheral surface 43 and finally projected onto the reflection cup 53, so that the light will be reflected by the reflection cup 53 and then collectively projected out of the front light-passing surface 511 of the front light-passing portion 51. In this way, the light is emitted from the front light-passing portion 51.

Figure 5:
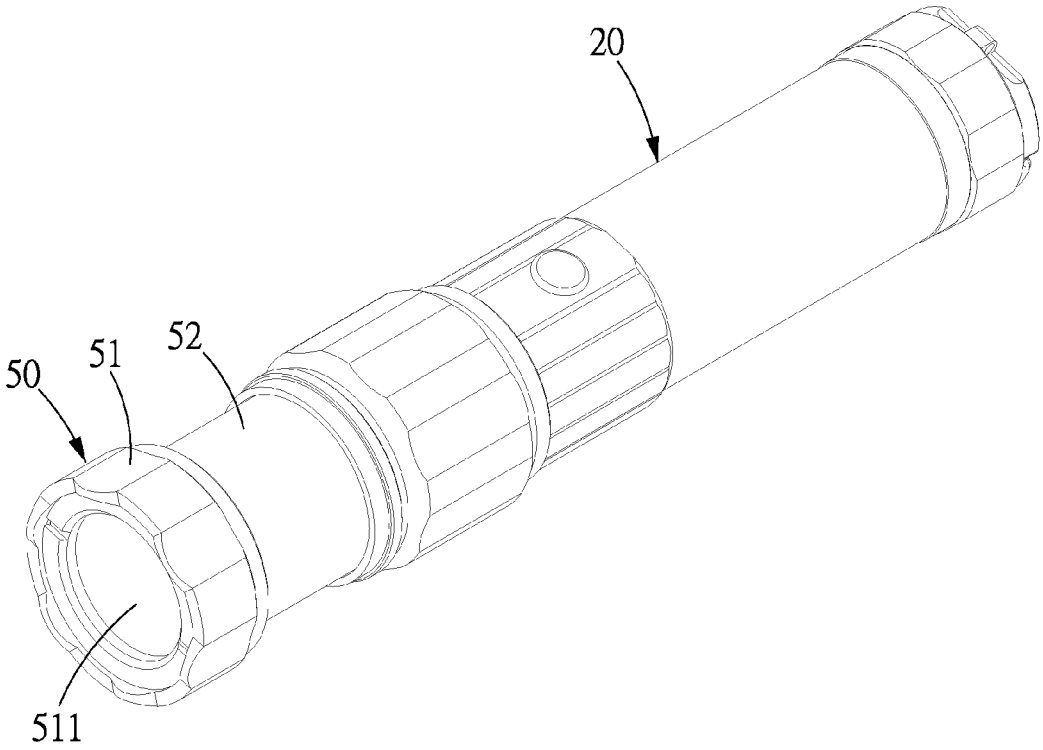
FIG. 5 shows a lateral emission condition of a lamp with light guide lens for lateral illumination in accordance with the present invention.
Figure 6:
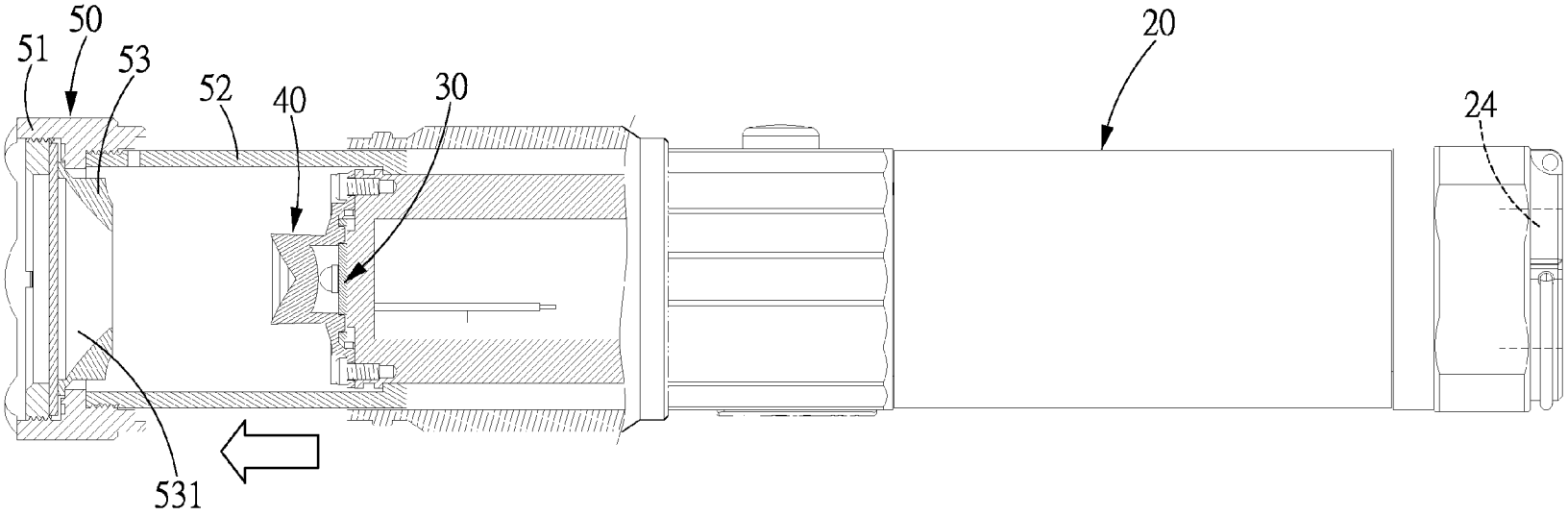
FIG. 6 is a partial cross sectional view of FIG. 5.
Figure 7:
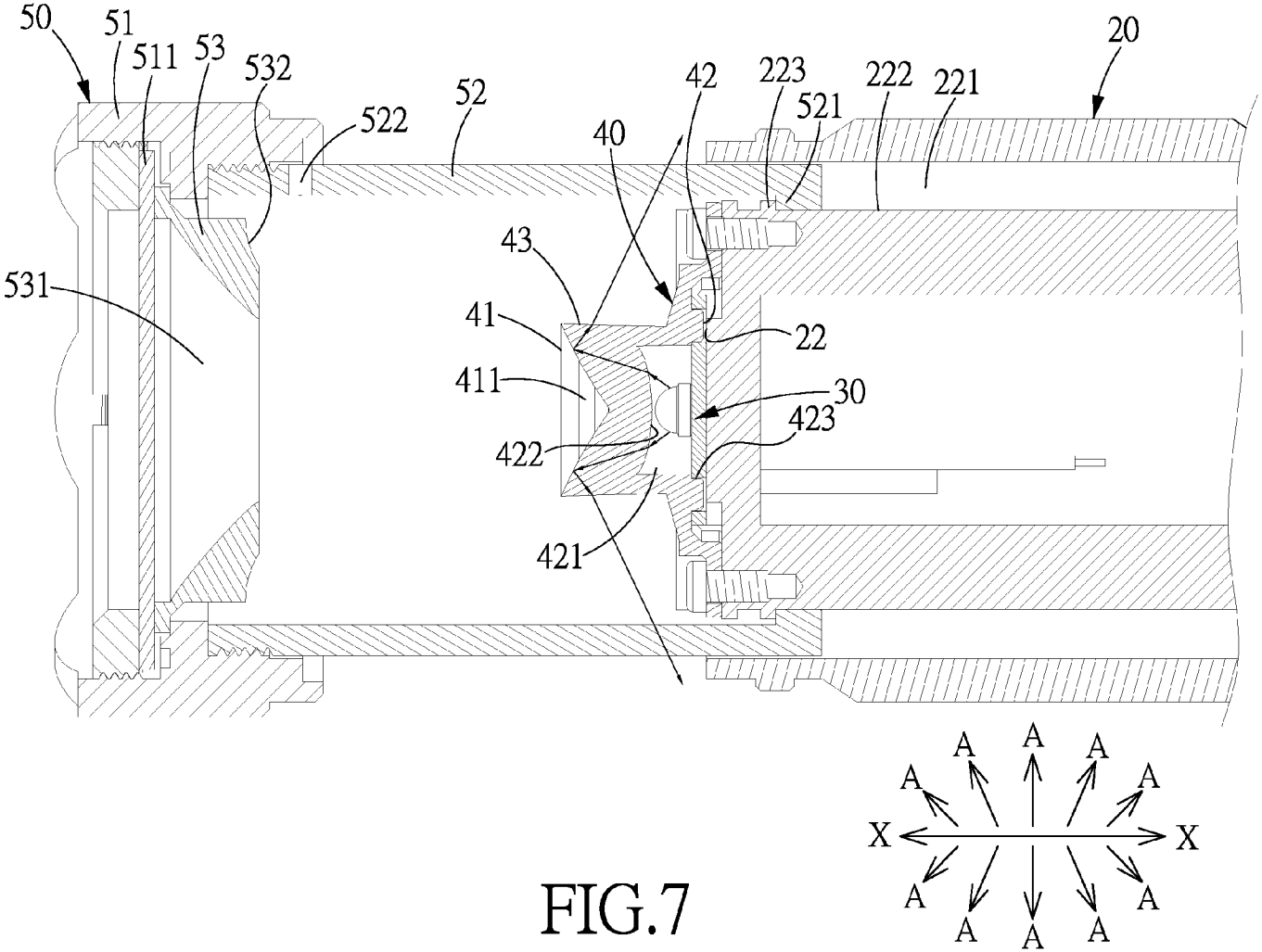
FIG. 7 is a cross sectional view of a part of FIG. 6.

To enable the light to be emitted in the lateral direction, as shown in FIGS. 5-7, the movable housing 50 can be pulled to pull the lateral light-passing portion 52 out of the body 20. When the lateral light-passing portion 52 moves until the limit portion 521 stops against the stop portion 223, it reaches the end of the travel length, and the limit portion 521 and the stop portion 223 prevent the disengagement of the movable housing 50 from the body 20. At this moment, the light emitted from the light emitting element 30 is reflected toward the peripheral surface 43 by the reflection surface 411 of the light guide lens 40, and then the light is refracted to the reflection cup 53 of the movable housing 50 by the light guide lens 40, and finally the light is reflected by the reflection cup 53 and collectively projected out from the lateral light-passing portion 52. In this way, the light is emitted in the lateral direction.

The magnet 24 is disposed at the rear end 23 of the body 20 and can be used to stuck the light apparatus of the present invention to different objects at different places, thus improving convenience of use. Furthermore, the slot 522 formed in the lateral light-passing portion 52 prevents the occurrence of nonuniform pressure between the movable housing 50 and the body 20, ensuring smooth movement of the movable housing 50.

With the light guide lens 40 and the movable housing 50 movably disposed on the body 20 of the light emitting apparatus, light is allowed to be collectively emitted from the front light-passing portion 51 of the movable housing 50 in a forward emission manner by moving the movable housing 50 to a position where the light guide lens 40 is located within the movable housing 50, or the light can be emitted from the lateral light-passing portion 52 in a lateral emission manner by moving the movable housing 50 to a position where the light guide lens 40 is not located within the movable housing 50.

While we have shown and described various embodiments in accordance with the present invention, it is clear to those skilled in the art that further embodiments may be made without departing from the scope of the present invention.

What is claimed is:

1. A lamp with light guide lens for lateral illumination, comprising:

a body with a front end and a rear end, a direction extending from the front end to the rear end being defined as an axial direction, and a non-axial direction being defined as a lateral direction;

a light emitting element disposed at the front end of the body;

a light guide lens disposed at the front end of the body and abutting against the light emitting element, the light guide lens including a first end, a second end and a peripheral surface between the first and second ends, a concave reflection surface concave toward the second end being formed at the first end to reflect a light emitted from the light emitting element into the lateral direction, and the second end being formed with a recess for accommodation of the light emitting element, wherein the recess includes a bottom surface and an open end, and the bottom surface is an arc-shaped surface convex toward the open end; and a movable housing movably disposed at the front end of the body and including a front light-passing portion, a lateral light-passing portion and a reflection cup between the front and lateral light-passing portions, the reflection cup including a hole facing the light guide lens, when the movable housing moves until the light guide lens is located within the hole, the lateral light from the light guide lens will be reflected by the reflection cup and emitted out of the front light-passing portion, when the movable housing moves until the light guide lens is not within the hole, and the lateral light-passing portion extends out of the body, the lateral light from the light guide lens will be emitted out of the lateral light-passing portion.

2. The lamp with light guide lens for lateral illumination as claimed in claim 1, wherein the peripheral surface is inclined at an angle with respect to the axial direction.

3. The lamp with light guide lens for lateral illumination as claimed in claim 1, wherein the reflection cup includes an arc-shaped concave surface which is formed around a periphery of the hole and concave toward the light guide lens.

4. The lamp with light guide lens for lateral illumination as claimed in claim 1, wherein a magnet is disposed at the rear end of the body.

5. The lamp with light guide lens for lateral illumination as claimed in claim 1, wherein the body further includes a charging portion.

6. The lamp with light guide lens for lateral illumination as claimed in claim 1, wherein a slide groove extending in the axial direction is formed at the front end of the body and includes a slide-groove inner surface, on the slide-groove inner surface is formed a stop portion, the front light-passing portion is a cap structure with a front light-passing surface, the lateral light-passing portion has one end screwed to an inner surface of the front light-passing portion and another end formed with a limit portion, the lateral light-passing portion is made of light transmitting material and formed with a slot, the lateral light-passing portion of the movable housing is movably disposed in the slide groove of the body, and a travel length of the movable housing is limited by the limit portion and the stop portion.

7. The lamp with light guide lens for lateral illumination as claimed in claim 1, wherein a conjunction between the first end and the peripheral surface of the light guide lens is defined as a front top point, and a part of the reflection surface of the first end located closest to the second end is defined as a front bottom point, a part of the bottom surface located furthest from the first end is defined as a rear top point, a distance between the front top point and the front bottom point is defined as a first distance D1, a distance between the front bottom point and the rear top point is defined as a second distance D2, and they satisfy the relation: $0.7 \leq D2/D1$.

8. The lamp with light guide lens for lateral illumination as claimed in claim 7, wherein D1 and D2 satisfy the relation: $0.7 \leq D2/D1 \leq 1$.

* * * * *